US009023541B2

(12) United States Patent
Chellappa et al.

(10) Patent No.: US 9,023,541 B2
(45) Date of Patent: May 5, 2015

(54) LIQUID PHASE DESULFURIZATION OF FUELS AT MILD OPERATING CONDITIONS

(75) Inventors: Anand S. Chellappa, Albuquerque, NM (US); Donovan A. Pena, Albuquerque, NM (US); Zachary C. Wilson, Albuquerque, NM (US)

(73) Assignee: Intelligent Energy Inc., San Jose, CA (US)

( * ) Notice: Subject to any disclaimer, the term of this patent is extended or adjusted under 35 U.S.C. 154(b) by 1462 days.

(21) Appl. No.: 12/438,496

(22) PCT Filed: Aug. 24, 2007

(86) PCT No.: PCT/US2007/076804

§ 371 (c)(1),
(2), (4) Date: Feb. 12, 2011

(87) PCT Pub. No.: WO2008/025002

PCT Pub. Date: Feb. 28, 2008

(65) Prior Publication Data

US 2011/0143229 A1 Jun. 16, 2011

Related U.S. Application Data

(60) Provisional application No. 60/823,501, filed on Aug. 24, 2006.

(51) Int. Cl.

| | |
|---|---|
| ***H01M 8/06*** | (2006.01) |
| ***C10G 27/12*** | (2006.01) |
| ***C10G 27/14*** | (2006.01) |
| ***C10G 53/08*** | (2006.01) |
| ***C10G 53/14*** | (2006.01) |

(52) U.S. Cl.
CPC ..... *C10G 27/12* (2013.01); *C10G 27/14* (2013.01); *C10G 53/08* (2013.01); *C10G 53/14* (2013.01)

(58) Field of Classification Search
CPC ..... C10M 2201/062; C10M 141/02; C10N 2230/06; C08F 8/00; C08F 4/28
USPC ..... 428/327; 427/162; 524/401, 523; 977/902, 811; 429/410; 208/226, 240, 208/243, 244, 245, 246
See application file for complete search history.

(56) References Cited

U.S. PATENT DOCUMENTS

| | | | | |
|---|---|---|---|---|
| 3,413,104 | A * | 11/1968 | Mehmedbasich | 44/346 |
| RE32,104 | E * | 4/1986 | Gray | |
| 5,925,476 | A * | 7/1999 | Kawatsu | 429/424 |
| 6,485,853 | B1 | 11/2002 | Pettit et al. | |
| 2002/0090337 | A1 | 7/2002 | Canos et al. | |
| 2003/0064259 | A1 | 4/2003 | Gittleman | |

(Continued)

OTHER PUBLICATIONS

Later publication of international search report (A3 17/2008) (Apr. 24, 2008).

(Continued)

*Primary Examiner* — Cynthia H Kelley
*Assistant Examiner* — Monique Wills
(74) *Attorney, Agent, or Firm* — Baker and Hostetler LLP

(57) ABSTRACT

A simple, compact process for cleansing hydrocarbon fuel such as jet fuel is disclosed. This process involves subjecting the fuel to an oxidative desulfurization process in a desulfurization reactor followed by passing the fuel through an adsorption bed. The cleansed desulfurized fuel may then be utilized directly in generation of hydrogen for fuel cell applications.

19 Claims, 13 Drawing Sheets

(56) References Cited

U.S. PATENT DOCUMENTS

| | | | | |
|---|---|---|---|---|
| 2003/0136706 | A1* | 7/2003 | McDaniel et al. | 208/97 |
| 2004/0118747 | A1* | 6/2004 | Cutler et al. | 208/208 R |
| 2006/0021913 | A1* | 2/2006 | Ketley et al. | 208/208 R |
| 2006/0076270 | A1* | 4/2006 | Poshusta et al. | 208/208 R |
| 2006/0112636 | A1* | 6/2006 | Chellappa et al. | 48/61 |

OTHER PUBLICATIONS

International Preliminary Report on Patentability Chapter I (Feb. 24, 2009).

* cited by examiner

JP-8 fuel processor performance metrics.

| Metric | |
|---|---|
| Sulfur in fuel, (wppm) | > 1000 |
| Lifetime without replacement, h | > 5000 |
| Start-up time, min | < 30 |
| Power density, W/L | > 100 |
| Specific Power (W/kg) | > 100 |
| Sulfur in feed to SOFC, ppm | < 5 |
| Min Turndown ratio | 5:1 |
| Cost on nominal volumes ($/KWe) | ~ 1000 |

FIG. 9

| Metric | |
|---|---|
| Fuel Processor Efficiency | > 76% |
| System Efficiency | 30-35% |
| Gross Power, kWe | 1.2 |
| Parasitic Power, We | 160 |
| Net Power, kWe | 1.04 |
| Fuel consumption, ml(min-kWe) | 5.55 |
| Fuel consumption, ml(min-kWth) | 2.42 |

FIG. 10

LIQUID PHASE DESULFURIZATION OF FUELS AT MILD OPERATING CONDITIONS

RELATED APPLICATION

This application claims the benefit of and priority to U.S. Provisional Application Ser. No. 60/823,501, filed Aug. 24, 2006, the contents of which are incorporated by reference herein in its entirety.

BACKGROUND

1. Field

This disclosure relates to a method for removing sulfur from liquid fuels while operating at mild conditions (close to ambient) and by utilizing catalysts and adsorbents. The method is particularly suited for treating fuels for use in fuel processors associated with fuel cell power systems.

2. General Background

Sulfur removal from liquid hydrocarbons such as gasoline and diesel is an area of great interest due to the Environmental Protection Agency's mandate that the sulfur in gasoline should not exceed 30 ppm. In the case of diesel, regulations call for a reduction from 500 ppm to 15 ppm. This translates to an almost tenfold reduction in the current sulfur content from present levels. Sulfur reduces the life of noble-metal-based catalytic converters as it tends to form stable compounds with the active catalyst components. Sulfur also oxidizes to sulfur oxides, which are detrimental to the environment.

For fuel cell applications, sulfur is a poison to reforming catalysts, water-gas shift catalysts and noble metal catalysts that are used in the process train of a fuel processor. Sulfur also poisons the anode catalyst in the PEM fuel cell. The sulfur concentration in the fuel that enters the hydrogen generation system should therefore be less than 1 ppm for PEM applications and less than 30 ppm for Solid Oxide Fuel Cell (SOFC) applications. Per military standards (MIL-T-5634M/N), the maximum amount of total sulfur content in logistic fuels is 0.3 wt. % and therefore requires treatment prior to fuel processing.

Desulfurization of military logistic fuels such as JP-8 and Diesel (NATO-F76 Navy Distillate) is of vital importance for the deployment of shipboard (or on-board) hydrogen generators for fuel cell power systems. Well-known desulfurization methods such as hydro-desulfurization are not suitable for shipboard (or on-board) applications, since a means for hydrogen supply such as electrolysis is required. The "deep" sulfur compounds such as the benzothiophenes can be converted to lighter sulfur compounds such as H2S by operating the fuel processor at high temperatures (800° to 900° C.—ATR units); the lighter sulfur compounds are then removed by using ZnO based adsorbent beds.

On a commercial scale, sulfur in fuels is removed by the hydro desulfurization (HDS) process. HDS requires pure hydrogen to be co-fed along with the fuel to prevent catalyst deactivation. The gas (hydrogen)-liquid (fuel) reaction is conducted over a solid catalyst at 300° C. to 350° C. and 50 to 100 bar, and is limited by mass transfer resistances. Vapor phase HDS has been conducted over catalysts such as supported molybdenum carbides and nitrides in the laboratory at 420° C. and ambient pressure, but the long-term stability of these catalysts remains to be determined. (M. E. Bussell, K. R. McRea, J. W. Logan, T. L. Tarbuck, J. L. Heiser, J. Catal., 171, p 255, 1997.)

SUMMARY OF THE DISCLOSURE

The method of cleansing sulfur compounds found in commercial hydrocarbon fuels in accordance with the present disclosure involves essentially three steps: introducing an oxidizer into a hydrocarbon fuel containing thiophenic sulfur compounds; passing the hydrocarbon fuel containing thiophenic sulfur compounds and the oxidizer through an oxidative desulfurization reactor (ODS) containing a catalyst to convert the thiophenic sulfur compounds to sulfones; and passing the hydrocarbon fuel containing sulfones through an adsorbent bed to adsorb the sulfones. The cleansed fuel may then be sent through a hydrogen generating reactor such as a CPDX/ATR reactor for further reduce the concentration of sulfur compounds.

This process, which takes place at mild operating conditions, can produce a fuel containing a concentration of sulfur compounds less than about 30 ppm, for subsequent use in production of hydrogen for fuel cell applications from a conventional jet fuel having a sulfur content in excess of 1000 ppm, sulfur. The method of cleansing may also include an operation of regenerating the adsorbent with ambient air or an oxygen-containing process stream in a fuel cell process system.

The oxidizer may include any oxygenate substance such as ethers, alcohols, organic peroxides, dialkyl peroxides, or diacyl peroxides, Luperox type peroxides, lauryl peroxides, ozone, or air. The catalyst may be a molybdenum oxide, supported molybdenum oxide, transition metal doped molybdenum oxide, molybdenum carbide or a partial oxidation catalyst including ferric molybdates, bimetallic oxides including CuO—Mo03, ZnO—Mo03, VO2-Mo03, V2O5, Cr2O3-MoO3, bimetallic carbides, boron phosphates, MgO and noble metals. The catalyst may be coated onto a wall of the reactor or placed or positioned on a feature present inside the reactor.

The adsorbent preferably includes one or more of MCM-41, MCM-48 (Mesoporous Crystalline Materials), colloidal silicas, aluminosilicates, amorphous silicas, and co-oxide silicas. The adsorbent may also be modified with a transition metal or transition metal oxide including Aluminum, Zirconium, Titanium, Vanadium, Chromium, Manganese, Iron, Cobalt, Nickel, Copper, and Zinc. The adsorbent in the adsorbent bed may also be selected from the group consisting essentially of silica, silica gel, high surface area oxides, titania and transition metals and carbon. The adsorbent may be in the form of a coating on a porous metal or ceramic support, a coating on walls of the reactor, or a coating on a feature present in the reactor. The adsorbent may optionally be dehydrated prior to use.

The ODS reactor and CPDX/ATR reactor each is preferably a hollow body having a large surface area for reactions and may be a microchannel or mesochannel reactor.

DRAWINGS

The above-mentioned features and objects of the present disclosure will become more apparent with reference to the following description taken in conjunction with the accompanying drawings wherein like reference numerals denote like elements and in which:

FIG. 1 shows GC-FPD traces of commercial diesel fuel (bottom) and ODS treated diesel fuel (top). ODS treated fuel trace has been magnified 50 times as a guide to the eye. 140° C., 40 psig. Fuel flow rate=0.5 ml/min. Catalyst loading: 1 g. 0/S=14.

FIG. 2 shows GC-FPD traces of Jet-A fuel (bottom) and ODS treated diesel fuel (top). ODS treated fuel trace has been magnified three times as a guide to the eye. 140° C., 40 psig. Fuel flow rate=0.5 ml/min. Catalyst loading: 1 g. 0/S=14.

FIG. 3 shows GC-FPD traces of diesel fuel (bottom) and ODS treated diesel fuel. Fuel flow rate=0.5 ml/min. Catalyst loading: 1 g. 0/S=14. ODS Treatment of diesel: From top: 1: (150° C., 40 psig); 2: (100° C., 40 psig); 3: (100° C., 0 psig), 4: (80° C., 0 psig). 5: Commercial Parent diesel.

FIG. 4 shows adsorption of sulfur in ODS treated diesel fuel over silica gel adsorbent at ambient temperature and pressure. Fuel flow rate=0.21 ml/min. Adsorbent loading: −4 g. Breakthrough time (<5 ppm S)=5 h. Baseline sulfur content=<5 ppm as measured by ASTM D5453.

FIG. 5 shows adsorption of sulfur in ODS treated diesel fuel over silica gel adsorbent and after one regeneration at ambient temperature and pressure. Fuel flow rate=0.21 ml/min. Adsorbent loading: −4 g. Breakthrough time (<5 ppm S)=5 h. Baseline sulfur content=<5 ppm as measured by ASTM D5453.

FIG. 9 is a table showing key metrics for JP-8 fuel processor metrics.

FIG. 10 is a table of key characteristics of a targeted power system.

DETAILED DESCRIPTION

In a first example, 550 ml of commercial diesel fuel was mixed with 7 ml of commercially available 70% tert-butyl hydroperoxide (aqueous TBHP, Alfa Aesar). The sulfur content in the parent fuel was found to be 269 ppm by ASTM D4294 method. The mixture was fed to a reactor containing a catalyst at a liquid hourly space velocity of 20 h-1 at 150° C. and 40 psig. The catalyst consisted of 19 wt. % MoO3 on a high surface area oxide support and was synthesized by incipient wetness impregnation. The high surface support contained, in weight percent (wt. %), >92 wt. % alumina, 1 wt. %, to 10 wt. % calcium oxide more preferably 1 to 5 wt. % calcium oxide and 0.5 wt. % to 5 wt. % magnesium oxide, and more preferably 0.5 wt. % to 2 wt. %, magnesium oxide. Such catalyst supports are available from Saint Gobain Norpro. The catalyst was calcined at 600° C. prior to being used for fuel treatment. Two to three liters of the treated fuel was produced.

Figure 1:
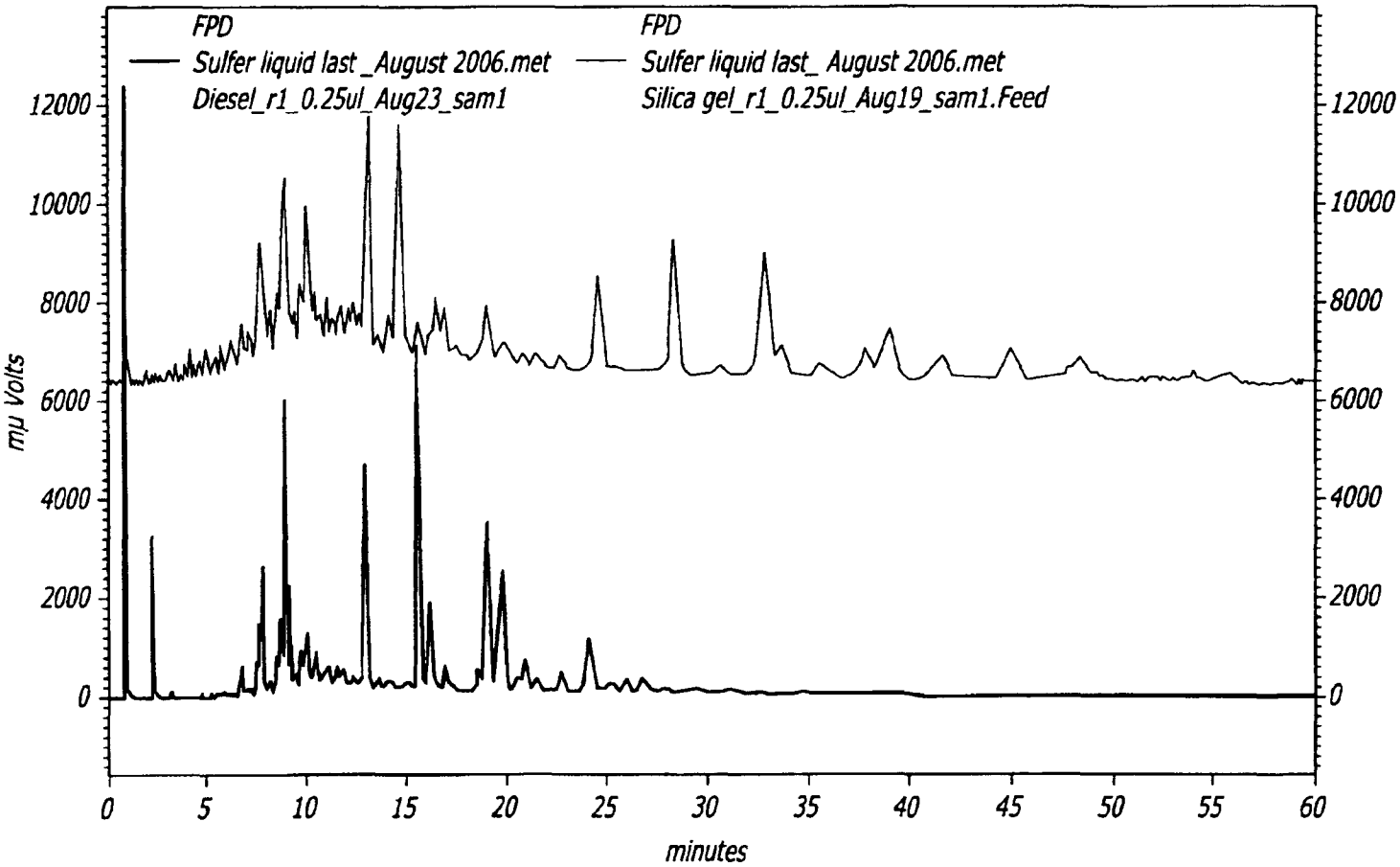

FIG. 1 shows the GC-FPD traces of commercial fuel before and after ODS treatment. The new peaks that are found in the trace of the treated fuel correspond to the converted forms of the thiophenic sulfur moieties in the parent fuel. We have also found that ODS treatment is more selective to convert the refractory compounds (such as the benzothiophenic moieties), which are primarily responsible for reducing reformer and system level performance.

In a second example, 550 ml of Jet-A fuel was mixed with 34 ml of 70% TBHP (aqueous, Alfa Aesar). The sulfur content in the parent fuel was found to be 1245 ppmw by AED (Grace) and 1040 ppmw by XRF (Analysts, Inc.). The mixture was fed to a reactor containing a catalyst at a liquid hourly space velocity of 20 h-1 at 150° C. and 40 psig. The catalyst consisted of 19 wt. % MoO3 on a high surface area oxide support and was synthesized by incipient wetness impregnation. The high surface support contained, in weight percent (wt. %), >92 wt. % alumina, 1 wt. °A), to 10 wt. % calcium oxide more preferably 1 to 5 wt. % calcium oxide and 0.5 wt. % to 5 wt. % magnesium oxide, and more preferably 0.5 wt. % to 2 wt. %, magnesium oxide. Such catalyst supports are available from Saint Gobain Norpro. The catalyst was calcined at 600° C. prior to being used for fuel treatment.

Figure 2:
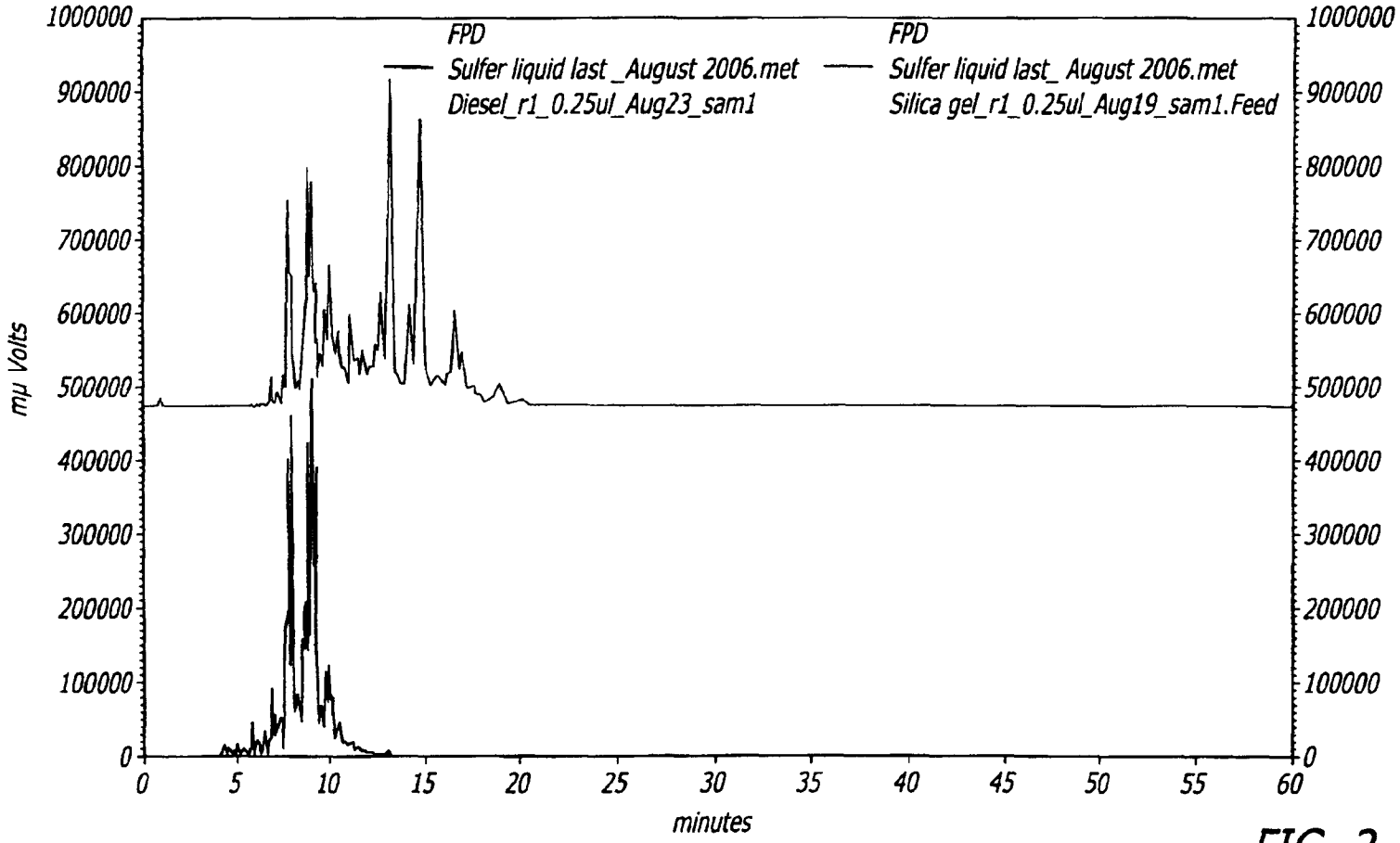

FIG. 2 shows the GC-FPD traces of Jet-A fuel before and after ODS treatment. The GC-FPD traces of Jet-A fuel are on the bottom and ODS treated diesel fuel is on top. ODS treated fuel trace has been magnified three times as a guide to the eye. The new peaks that are found in the trace of the treated fuel correspond to the converted forms of the thiophenic sulfur moieties in the parent fuel. We have also found that ODS treatment is more selective io convert the refractory compounds (such as the benzothiophenic moieties), which are primarily responsible for reducing reformer and system level performance.

In a further example, 550 ml of commercial diesel fuel was mixed with 7 ml of 70% TBHP (aqueous, Alfa Aesar). The sulfur content in the parent fuel was found to be 269 ppm by ASTM D4294 method. The mixture was fed to a reactor containing a catalyst at a liquid hourly space velocity of 20 h-1 at different temperatures and pressures. The catalyst consisted of 19 wt. % MoO3 on a high surface area oxide support and was synthesized by incipient wetness impregnation. The high surface support contained, in weight percent (wt. %), >92 wt. % alumina, 1 wt. %, to 10 wt. % calcium oxide more preferably 1 to 5 wt. % calcium oxide and 0.5 wt. % to 5 wt. % magnesium oxide, and more preferably 0.5 wt. % to 2 wt. %, magnesium oxide. Such catalyst supports are available from Saint Gobain Norpro. The catalyst was calcined at 600° C. prior to being used for fuel treatment.

Figure 3:
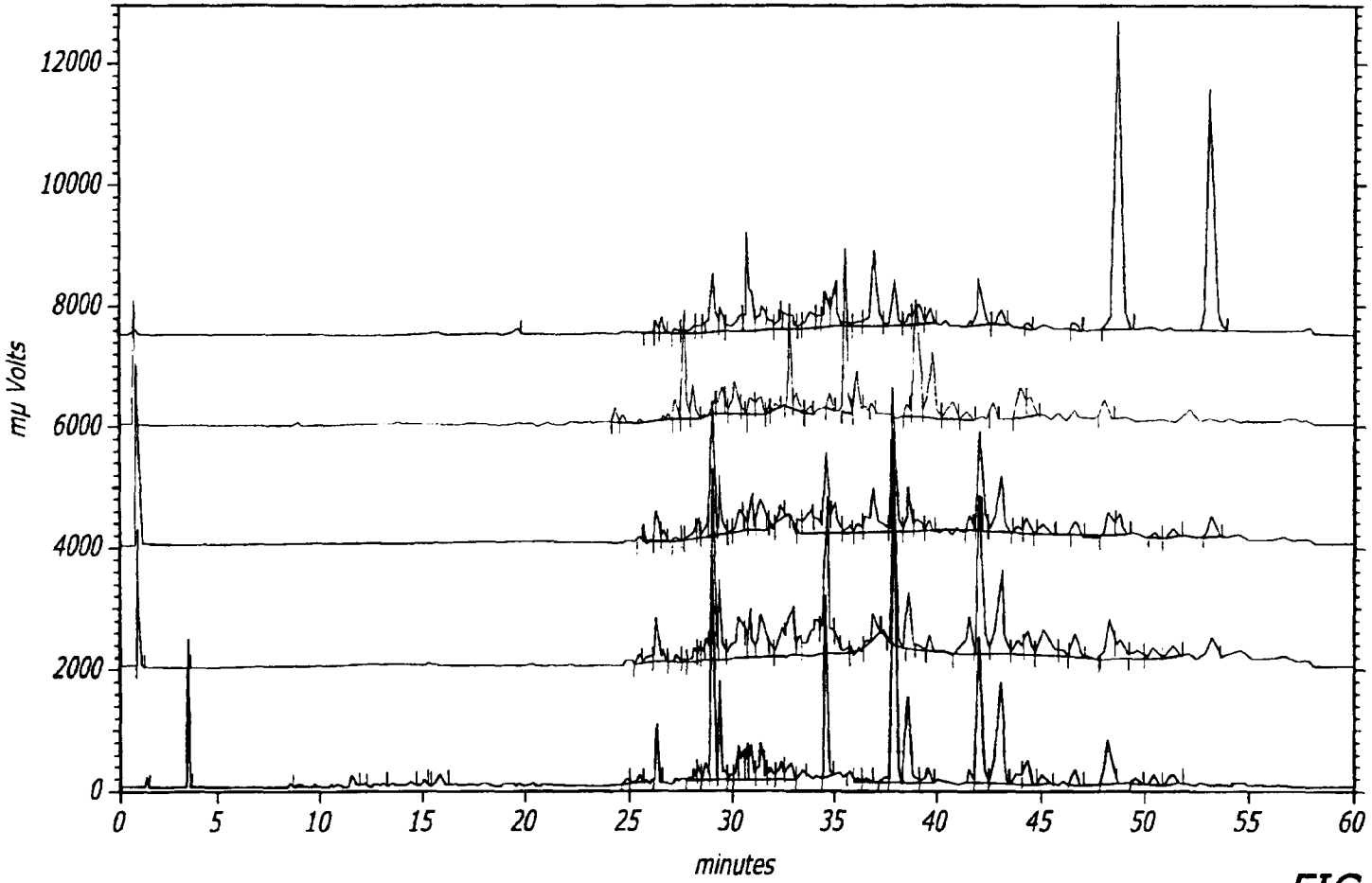

FIG. 3 shows the GC-FPD traces of the commercial diesel fuel before (bottom) and after (top) ODS treatment. From the top: 1—(150° C., 40 psig); 2—(100° C., 40 psig); 3—(100° C., 0 psig); 4—(80° C., 0 psig). We found that conducting ODS treatment at 150° C. and 40 psig were suitable conditions to achieve good conversion of the thiophenic sulfur compounds found in the commercial diesel fuel.

Figure 4:
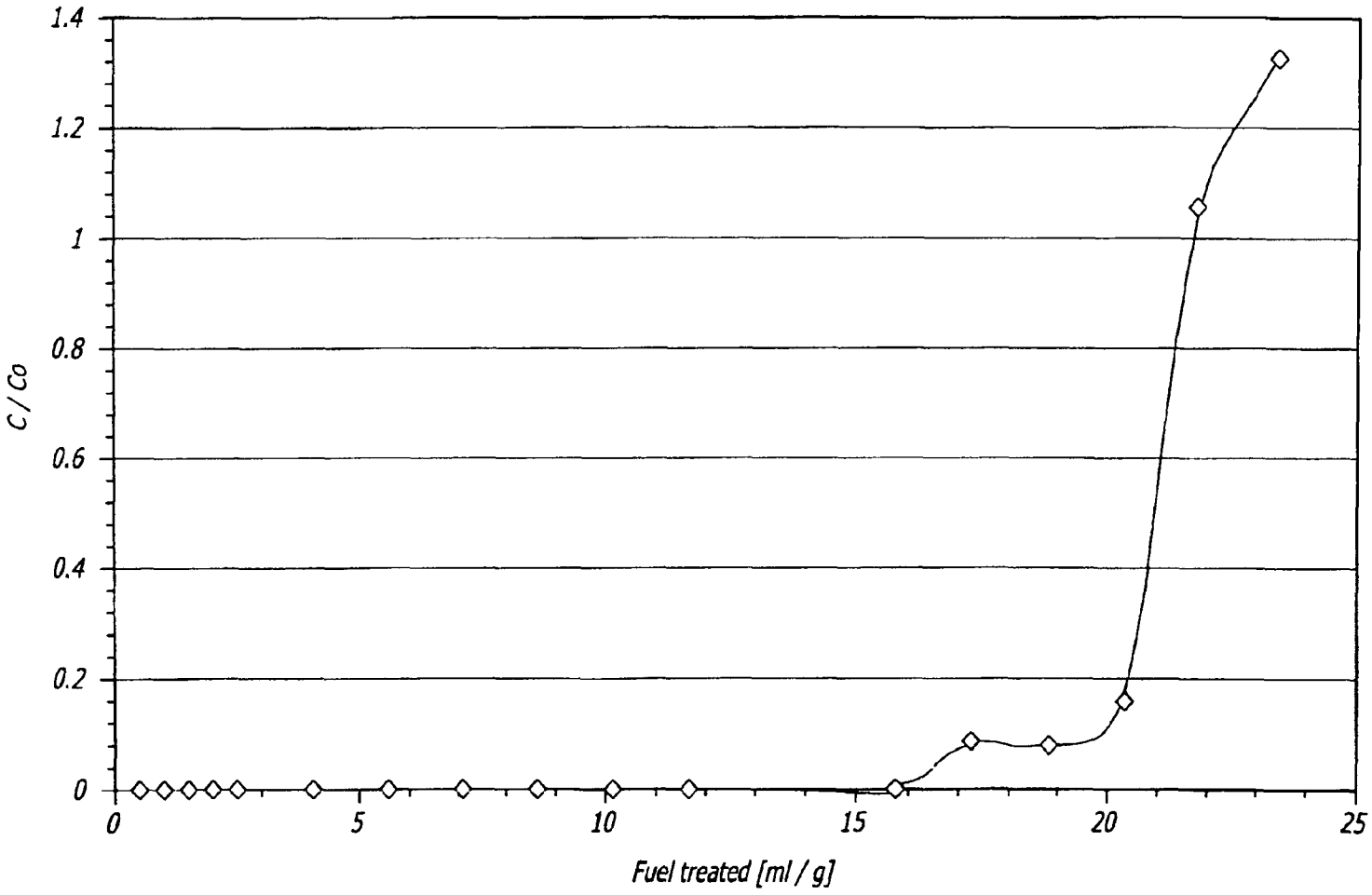

The ODS treated fuel that was produced in the first example was passed through an adsorbent bed containing commercial silica gel. As shown in FIG. 4, an adsorbent capacity of 15 ml fuel/g adsorbent was achieved at <5 ppm S breakthrough (as measured by ASTM D5453). A capacity of >30 ml fuel/g is anticipated at the targeted breakthrough sulfur level of <30 ppm.

Fuel Clean Up

Figure 6:
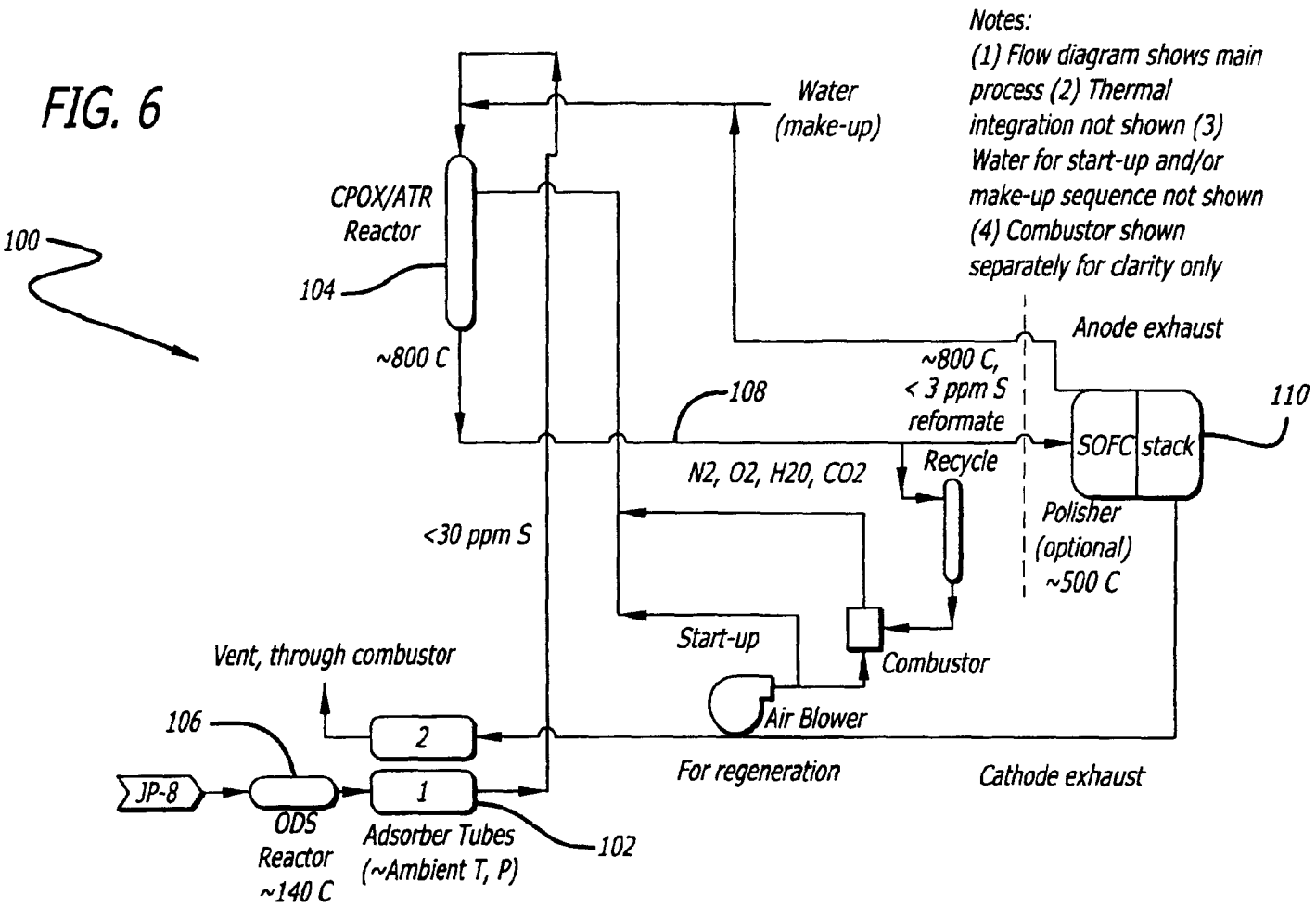
FIG. 6 shows a generalized flow diagram showing integration of the sulfur clean-up method in an SOFC fuel cell power system.

A generalized process flow diagram is shown in FIG. 6, which illustrates the system flow in accordance with this disclosure. The process is generally divided into two subsystems namely:

(1) Fuel Clean-up and Processing; and (2) SOFC stack.

In this process example, JP-8 fuel is subjected to a clean-up step to remove sulfur compounds. This is accomplished using a two-step process in accordance with this disclosure. In the first step, the fuel is dosed with a fuel soluble oxidant—t-butyl hydro peroxide (TBHP)—and is treated over a catalyst (typically low-cost supported molybdenum oxide) at nominal operating conditions of 140° C. and 40 psig. This oxidative desulfurization (ODS) treatment converts the thiophenic compounds native to the JP-8 fuel forms that are more readily removed using adsorbents. These sulfur forms (sulfones constituents or otherwise) are selectively and easily removed using common adsorbents (low-cost, non-pyrophoric materials such a silica gel); more importantly, the adsorbents are easily regenerable using oxygen containing process stream (e.g. cathode exhaust stream) at about 350° C. The cleaned fuel contains less than 30 ppm sulfur in the liquid phase and therefore, the resulting reformate from the fuel processor stream will contain less than 3 ppm sulfur and is suitable for SOFC use.

The amount of oxidant to be added could be determined by knowing the sulfur content of the fuel a priori, or by in-line measurement of sulfur using any suitable method.

Figure 7:
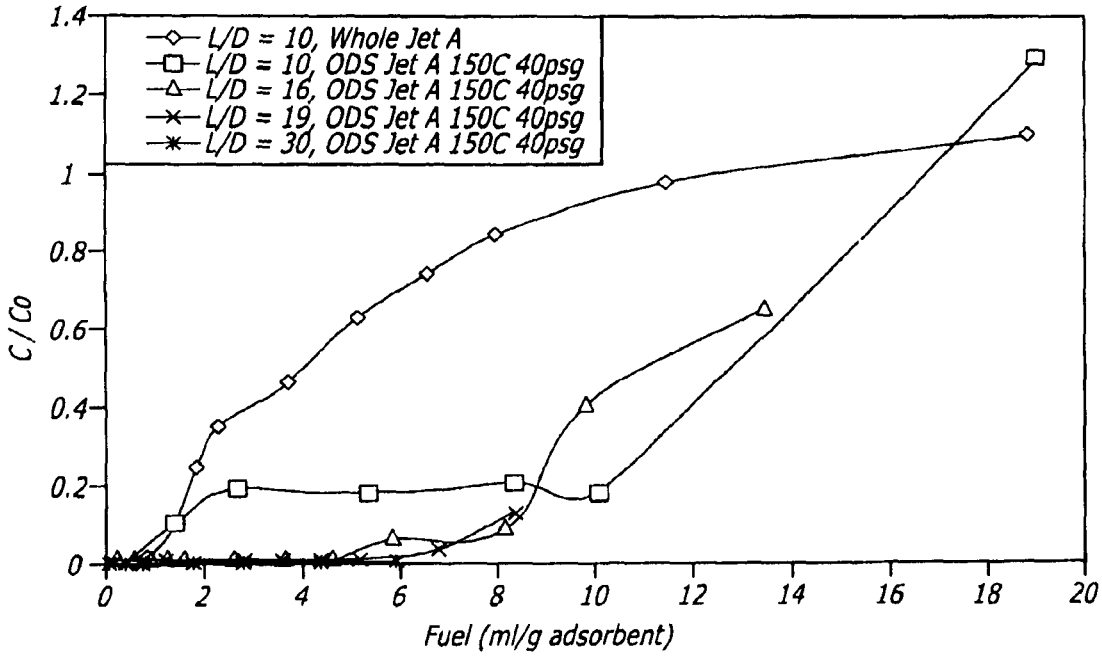
FIG. 7 is a graph of packed column adsorption experiments performed with Jet-A (−950 ppmw S) and silica gel-MA at different values of L/D.

We have demonstrated that the sulfur content in Jet-A can be reduced from 1000 ppm, to 30 ppm, at 6 mL fuel/g adsorbent capacity (FIG. 7). FIG. 7 shows packed column adsorption experiments performed with Jet-A (–950 ppm, S) and silica gel-MA at different values of L/D. An aqueous solution of 70 vol. % tert-butyl hydroperoxide was added so that it was 5.8 vol. % of the total mixture. This results in a true tert-butyl hydroperoxide concentration of 4.1 vol. % and an 0:S ratio of 18.

About two liters of ODS-treated fuel was produced during a catalyst durability test that spanned about 50 hours. Catalyst activity was found to be stable.

Based on our ODS and adsorption test data, preliminary sizing of the sulfur removal system to support a 1 kWe net SOFC power system was done. Key estimates are as follows:

(1) The ODS reactor is very compact. 1.9 cm diameter×11 cm L; 30 cc catalyst volume;

(2) Adsorber consisting of two beds: 5 cm diameter×27 cm length; 300 g bed weight in each tube;

(3) Adsorber TOS=eight hours; regeneration=one hour; and, (4) Operating conditions: ODS reactor (150° C., 40 psig); Adsorber (ambient T, P); Adsorber regeneration: <350° C. in air.

These results highlight the advantages of our approach for sulfur removal, namely:

Simple process, simple hardware: No fractionators or recycle of slip stream;

Mild operating conditions;

No pyrophoric materials (e.g. Ni, Zn and nano-particle) or boutique adsorbents containing several noble metals are needed;

Easily regenerable adsorbents. There is no need for complicated moving bed or rotary valve adsorption systems. Regeneration is accomplished by oxidation using air at 350° C. (a process stream such as cathode off gas can be used when integrated in a fuel cell power system). Just two adsorption beds are sufficient;

Regeneration is straightforward since it is not influenced by exotherms;

Since there is no sulfur-rich slip stream that needs to be stored or returned to a vehicle's fuel tank, fuel is processed and used as needed;

Catalysts and adsorbent materials do not contain any precious metals; and

Low capital cost.

The amount of oxidant (70% TBHP) in the feed to the ODS reactor is about 5 vol. %. Even at these dosage levels, we estimate that the cost of oxidant could be less than $20 for treating one barrel—roughly 600 hours of continuous operation of a 1 kW power system—of Jet-A fuel (1000 ppmw S). The catalyst and adsorbent costs are expected to be minimal since the materials do not contain any precious metals; both materials are expected to be characterized by long lifetimes. Operating and maintenance costs are also expected to be very low since the process is simple. Finally, hardware costs are also expected to be low since the sulfur removal subsystem would simply consist of three tubes.

Figure 5:
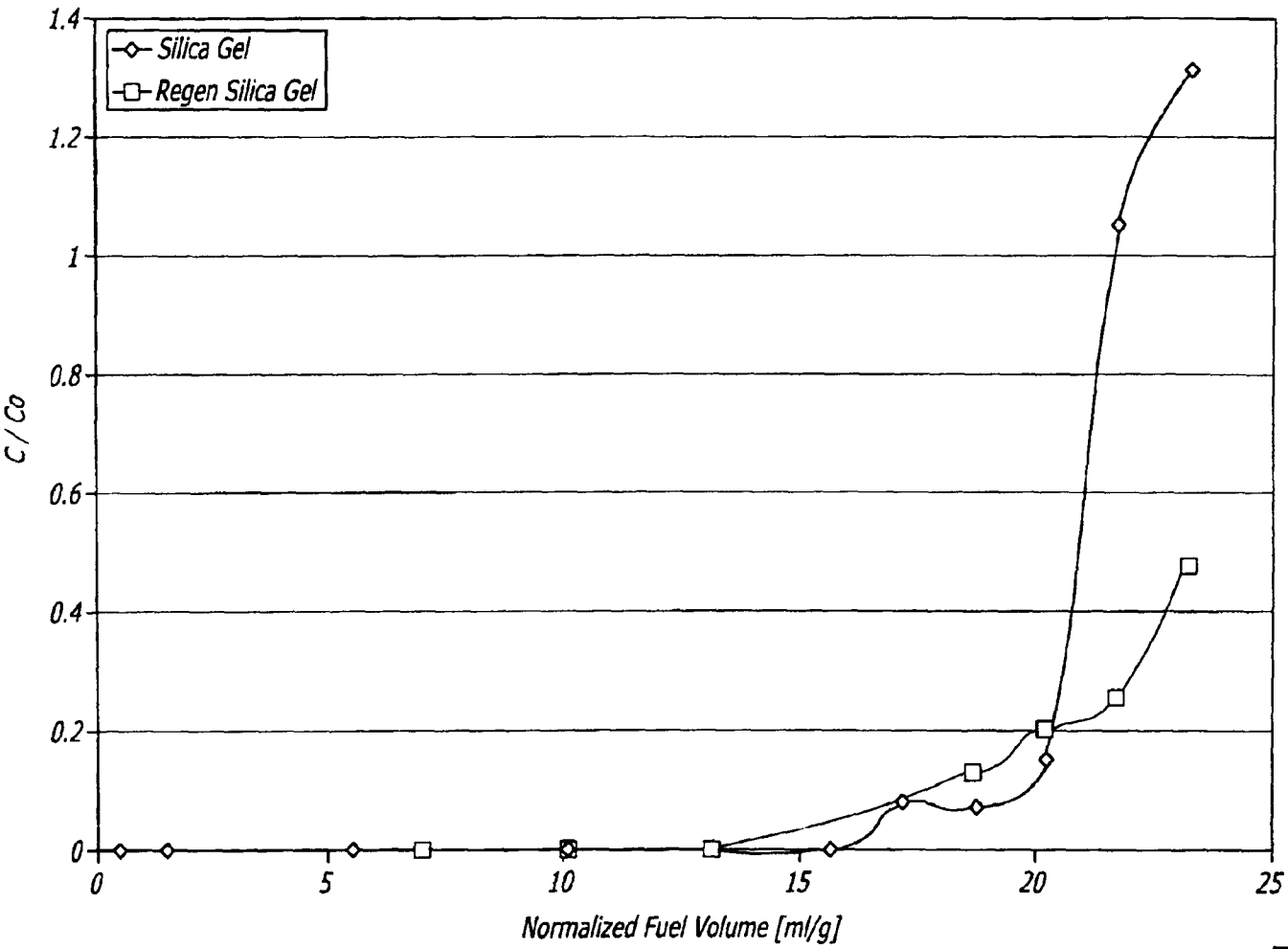

The adsorbent was also successfully regenerated four times by heating to 350° C. in air. Regeneration at the relatively mild temperature of 350° C. allows for easy integration of the S removal subsystem into a logistic fuel-to-power fuel cell system. The capacity of regenerated silica gel to absorb sulfur in ODS treated diesel fuel is shown in FIG. 5.

Fuel Processing

FIG. 6 shows a system 100 comprising an ODS/adsorber processing scheme providing cleansed JP-8 fuel to a solid oxide fuel cell (SOFC) stack 110. The processing system 100 basically includes a series arrangement of an oxidative desulfurization reactor 106 and an adsorber 102, coupled through a reactor 104. As shown in the exemplary flow diagram of system 100 in FIG. 6, the fuel stream containing <30 ppm sulfur, after passing through the OD reactor 106 and then leaving the adsorbent bed 102, is then routed to a reactor 104 that is operated in the CPDX mode during start-up with some water sparging, and then in an ATR/CPDX mode during steady-state operation. The reactor 104 is operated at space velocities greater than 50K h-1, and at nominal operating temperatures of 800° C. and 1 bar. The reformate stream (<3 ppm S) 108 is directly routed to the SOFC stack 110. Heating during start-up is preferably accomplished by combustion of the desulfurized fuel.

Water required for ATR mode operation (S/C 1, 0/C—1) is generated by catalytically combusting a fraction, typically 8-10% of the reformate stream or will be supplied by recycle of the SOFC anode waste gas. ATR is used since some water is cycled to the reformer. Since the recycle reformate stream contains low levels of sulfur (<3 ppm, in the form of SOx, H2S), a small polisher cartridge could be installed to essentially remove this sulfur from the recycle stream. This cartridge will be designed to last the life of the mission (600 hours) and would contain about 20 g of the RVS-1 type adsorbent that was developed at NETL (sold by Sid Chemie). Typical operating conditions for the adsorber are 500° to 650° C. and 1 bar.

The recycle reformate gas at the entry of the reformer is expected to contain about 2% CO2. Since CO2 is a good dry reforming oxidant, it is expected that the presence of low levels of CO2 would have a beneficial effect on reformate production.

As shown in the flow diagram 100 of FIG. 6, the anode off gas could be potentially routed to the reformer and the cathode-side off gas to the adsorber during regeneration. As shown in FIG. 1, the fuel containing <30 ppm S can be processed by a CPDX/ATR reactor. The challenging weight and size targets, start-up times and near-zero water requirement for military applications may rule out the use of the more efficient steam reforming process for reformate production. CPDX/ATR methods have been demonstrated by others (DOD Logistic Fuel Reforming Conference (2005)) for fuel cell applications. The fuel clean-up method in the present disclosure facilitates an efficient, compact and reliable SOFC system based upon the following reasons:

(1) Sulfur clean-up downstream of the reformer in SOFC systems requires cooling of the reformate gas to around 600° C. for use of RVS-1 type adsorbents (Siriwardane, R. V. et al., "Durable ZnO based regenerable sorbents for desulfurization of syngas in a fixed bed reactor" NETL) and then heating-up to meet requirements of the SOFC. This leads to system level inefficiencies.

(2) Sulfur removal by air oxidation does not remove the problematic refractory compounds (>BT) found in logistic fuels requiring downstream sulfur removal.

The sulfur removal approach in accordance with the present disclosure exhibits remarkable propensity for removal of the refractory compounds.

Since the targeted lifetime between maintenance is 600 hours, fuel processor operation in the 700° to 750° C. range and ambient pressure (or at P required for SOFC), which permits the use of conventional high temperature metals, is desired. While a penalty in terms of coking and some loss in performance will be incurred, lower machining and material costs can be realized. Coke formation and sulfiding of the walls of the reactor will preferably be mitigated by treating the metal surfaces with transition metal carbides using a rapid and low cost cold-spray technique.

The method of the present disclosure represents a novel effort to push the limits of existing state-of-the-art technologies to handle logistic fuels. Key metrics for a desired JP-8 fuel processor are listed in FIG. 9:

Preliminary Power System Model

Some key characteristics of the targeted power system are listed in FIG. 10.

The ODS-treated diesel fuel that was produced at 100° C. and 40 psig treatment was passed through an adsorbent bed containing commercial silica gel. Sulfur breakthrough was instantaneous. This shows that the thiophenic sulfur moieties present in the parent diesel fuel, and which remain in the treated fuel due to the choice of non-optimum operating conditions, are not amenable to removal using adsorbents.

Figure 8:
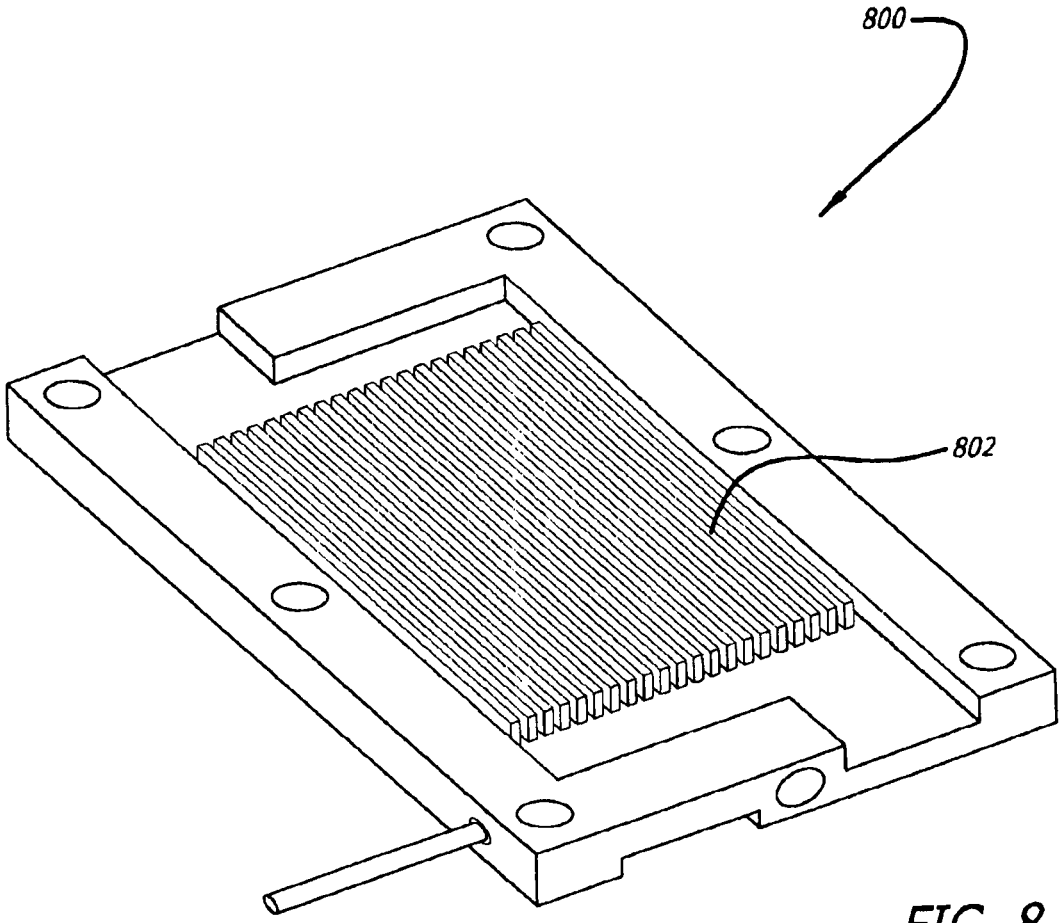
FIG. 8 is a perspective view of an exemplary mesochannel reactor with its cover removed to reveal the mesochannels.

Mesochannel reactors/adsorbers 800, one of which is shown in FIG. 8, offer high throughput per unit volume and good heat transfer characteristics; the latter is beneficial during reaction and regeneration of the adsorbents. The mesochannel reactor has a series of parallel channels 802 that provide a large internal surface area for reaction. The catalyst and/or adsorbent particles can be packed in the channels 802 of the mesochannel reactor/adsorber unit 800 that is capable of generating heat to support reaction and/or regeneration. The catalysts/adsorbents could alternatively be coated onto the walls of the reactors 800 or other features present inside the body of the reactor; the reactor 800 may also be heated by suitable heat exchange with process streams in a fuel cell system. Coating can be accomplished by any number of means including wet chemistry and spray techniques.

As an exemplary sample, commercial jet fuel with a sulfur concentration >1000 ppmw was procured from a local airport in Albuquerque. Sulfur levels were determined qualitatively with a Shimadzu GC that is equipped with a FPD. Quantitative results (Total S; ASTM D4294 and D5453) were obtained by shipping selected samples to an outside laboratory (Intertek—Caleb Brett, CA). ODS catalyst and adsorbent testing was conducted using packed bed reactors and adsorbent columns. The reactor and the adsorber were run in series to demonstrate sulfur reduction in a continuous mode. Regeneration was assessed by treating the spent adsorbents in air at 350° C. Packed column flow tests demonstrated the effectiveness of oxidative desulfurization on Jet-A. FIG. 7 compares the performance of a single type of silica adsorbent under different adsorber bed length-to-diameter (L/D) conditions. The large increase in sulfur adsorption by oxidized sulfur species relative to the native thiophenic sulfur species is demonstrated by the breakthrough curves for as-received Jet-A and oxidized Jet-A can be clearly seen. The dramatic increase in adsorbent performance with different loadings is shown as well. As can be seen, the adsorbent exhibited a breakthrough capacity of 31 ppm, S at 6 ml fuel/g adsorbent. The data demonstrates the ability of sulfone generation to dramatically boost the performance of a common, low-cost adsorbent.

A heat generation unit or heat exchanger can be integrated into the unit 100 to provide heat during adsorption and/or regeneration. For portable applications, if regeneration is not a necessity, the hardware can be used as disposable cartridges. The mild operating conditions permit the use of lightweight metals, such as aluminum, as materials of construction and lead to compact, lightweight adsorbers.

One additional differentiator between the process of the present disclosure and the processes disclosed in the prior art is that here it has been shown that an aqueous commercially available peroxide could be used for desulfurization. In contrast, in prior art systems, much effort is expended to remove and minimize water from the peroxide prior to subjecting the fuel to ODS.

Further illustrations of the advancements of the present disclosure are as follows.

Figure 11:
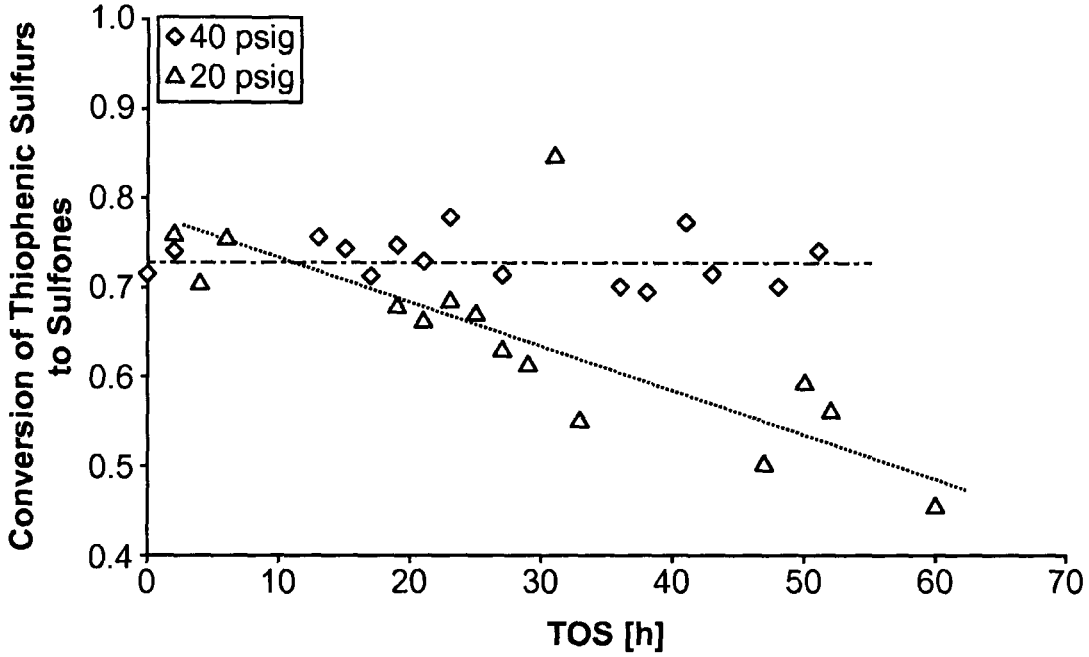
FIG. 11 is a graph of catalyst durability tests performed.

FIG. 11 shows the results of the catalyst durability test performed for oxidation of native thiophenic species to sulfones at 20 and 40 psig. The data show that conversion dramatically decreases after 50 h TOS at 20 psig but remains relatively constant at 40 psig. The catalyst turned completely black at 20 psig, suggesting coke formation as the deactivation mechanism. Other commercial oxidation catalysts that were tested at 40 psig had lower overall conversions relative to the in-house synthesized material after 50 h TOS.

Figure 12:
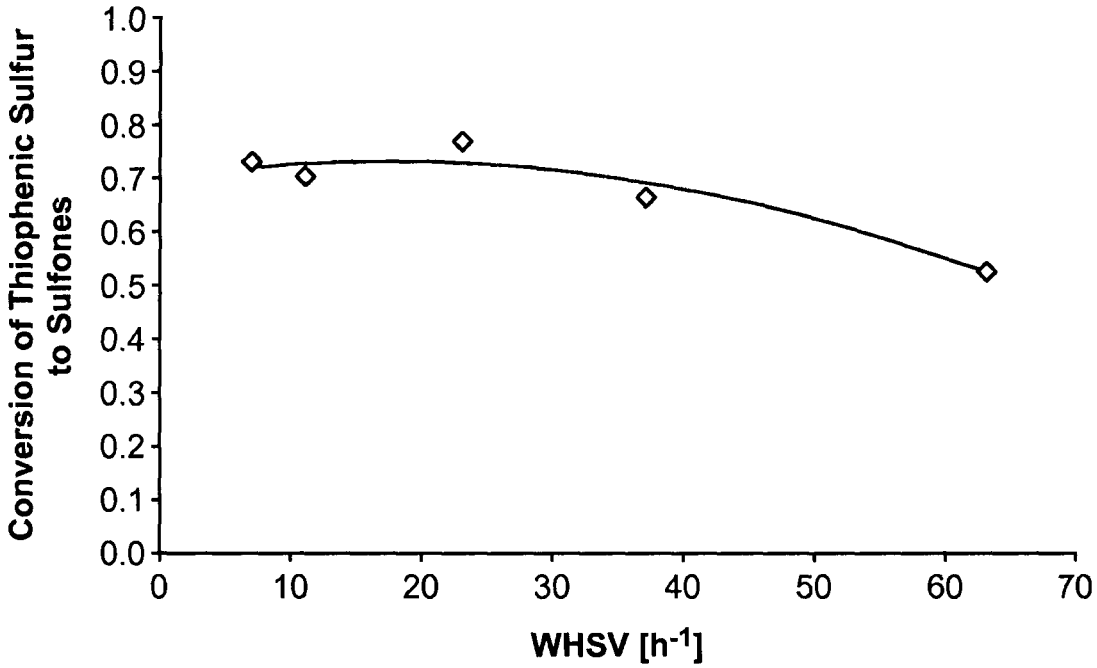
FIG. 12 is a graph of conversion of oxidative catalysts against weight hourly space velocity (WHSV).

FIG. 12 shows the results of the parametric study of WHSV (weight hourly space velocity) on the oxidation catalyst used during this work. Packaging requirements are crucial to industrial processes, and the data show that similar oxidation performance could be obtained at flow rates four times higher than what was used in this work.

Figure 13:
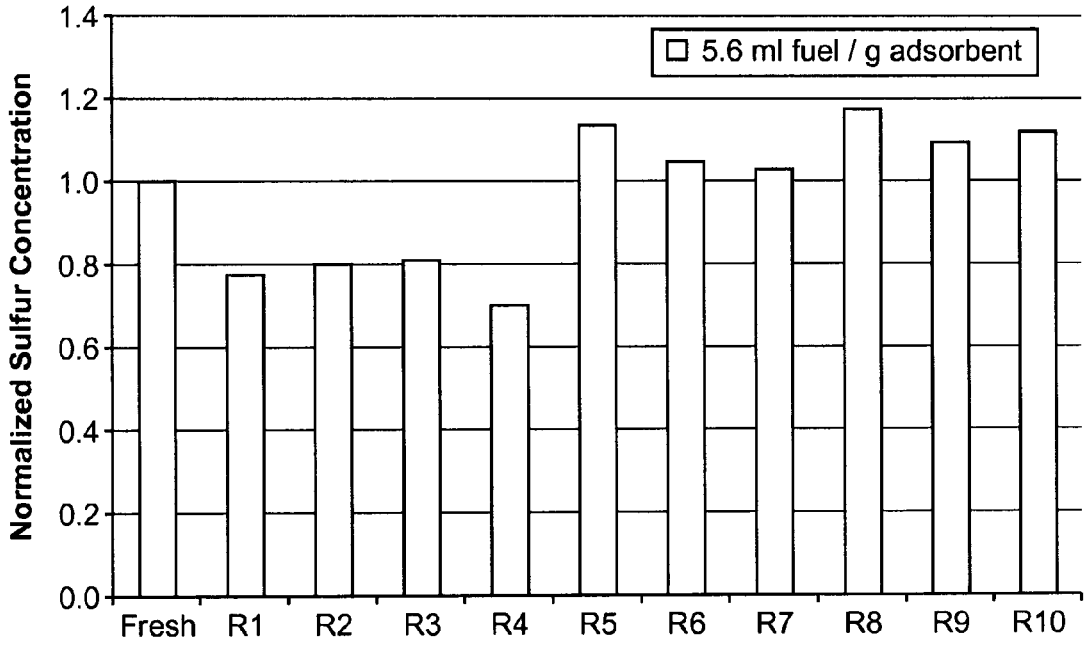
FIG. 13 is a graph showing regeneration results.

FIG. 13 shows the breakthrough capacity behavior of the same silica adsorbent over ten regeneration cycles. We stopped at ten cycles because our goal was to demonstrate initial proof of concept. The system, which has not been optimized, is capable of removing sulfur from Jet-A through ten regeneration cycles without any loss in performance.

Figure 14:
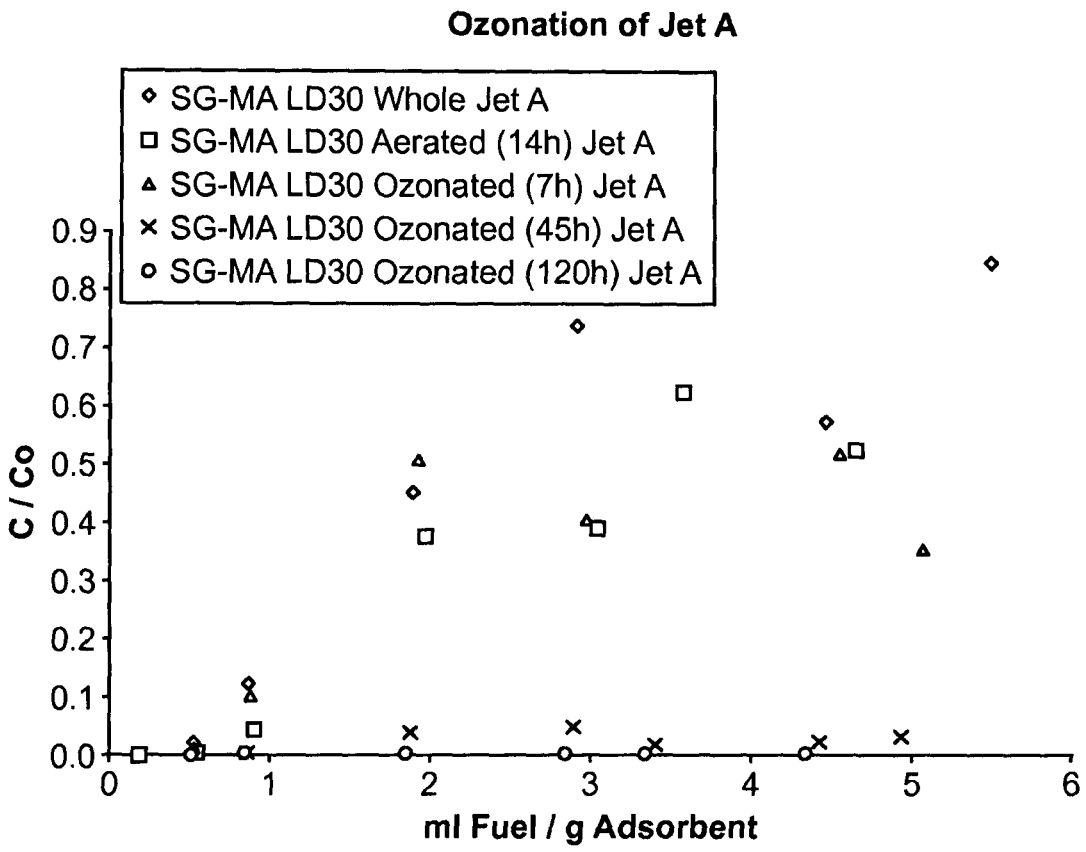
FIG. 14 is a graph summarizing ozonation of Jet-A.

FIG. 14 summarizes the work performed using ozone to oxidize sulfur compounds in Jet-A to sulfones. Ozonation was performed at room temperature and atmospheric pressure by bubbling ozonated air through the fuel in a batch mode. We believe that the same can be done in a flow reactor mode with or without a solid catalyst depending upon the fuel and the sulfur content in the fuel. It can be clearly seen that the sulfur compounds in ozonated Jet-A fuel is more readily removed by adsorption compared to un-ozonated (whole) Jet-A fuel.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method of removing sulfur compounds found in commercial hydrocarbon fuels comprising:

introducing an oxidizer into a hydrocarbon fuel containing thiophenic sulfur compounds; then passing the hydrocarbon fuel thiophenic containing sulfur compounds and the oxidizer through an oxidative desulfurization reactor containing a catalyst under oxidizing conditions to convert the thiophenic sulfur compounds to sulfones; and then passing the hydrocarbon fuel containing sulfones through an adsorbent bed to adsorb the sulfones and produce a fuel containing a concentration of sulfur compounds less than about 30 $ppm_w$;

wherein the catalyst comprises a molybdenum oxide, molybdenum carbide, a ferric molybdate, CuO—$MoO_3$, ZnO—$MoO_3$, $VO_2$—$MoO_3$, $V_2O_5$, or $Cr_2O_3$—$MoO_3$, MgO or a noble metal.

2. The method according to claim 1 wherein the oxidizer comprises an ether, alcohol, ozone, air, or organic peroxide oxygenate.

3. The method according to claim 1 wherein the catalyst comprises a supported molybdenum oxide or transition metal doped molybdenum oxide.

4. The method according to claim 1 wherein the catalyst is coated onto a wall of the reactor or on a feature present inside the reactor.

5. The method according to claim 1 wherein the adsorbent comprises MCM-41, MCM-48, colloidal silica, amorphous silica, co-oxide silica, or a mixture thereof.

6. The method according to claim 1 wherein the adsorbent is modified with a transition metal or transition metal oxide of Aluminum, Zirconium, Titanium, Vanadium, Chromium, Manganese, Iron, Cobalt, Nickel, Copper, or Zinc.

7. The method according to claim 1 wherein the adsorbent in the adsorbent bed is selected from the group consisting essentially of silica, silica gel, high surface area oxides, titania and transition metals, aluminosilicates, and carbon.

8. The method according to claim 1 wherein the adsorbent is one of a coating on a porous metal or ceramic support, a coating on walls of the reactor, or a coating on a feature present in the reactor.

9. The method according to claim 8 wherein the reactor is a mesochannel reactor.

10. The method according to claim 8 wherein the adsorbent is dehydrated prior to use.

11. The method according to claim 8 further comprising a step of regenerating the adsorbent with ambient air or an oxygen containing process stream in a fuel cell process system.

12. The method according to claim 1 wherein the catalysts and adsorbents are arranged in a stacked fashion.

13. The method according to claim 1 further comprising stacking adsorbents of different properties and formulations.

14. The method according to claim 1 further comprising stacking catalysts of different properties and formulations together.

15. The method according to claim 12 wherein the catalytic and adsorptions operations occur in a common reactor.

16. The method according to claim 1 further comprising routing fuel from the adsorbent bed directly to a reformer.

17. The method according to claim 15 wherein an operating temperature of the reactor permits locating the reactor near a hot zone of a fuel cell system.

18. The method according to claim 1 wherein the catalyst is in a liquid state.

19. The method of claim 2, wherein the organic peroxide oxygenate is a dialkyl peroxide or diacyl peroxide.

* * * * *